US009580229B2

(12) United States Patent
Thomas

(10) Patent No.: US 9,580,229 B2
(45) Date of Patent: Feb. 28, 2017

(54) BEVERAGE BOTTLE INSULATING APPARATUS

(71) Applicant: Elias-Thomas Innovations, L.L.C., Dallas, TX (US)

(72) Inventor: Dennis P. Thomas, Denton, TX (US)

(73) Assignee: Elias-Thomas Innovations, L.L.C., Dallas, TX (US)

( * ) Notice: Subject to any disclaimer, the term of this patent is extended or adjusted under 35 U.S.C. 154(b) by 24 days.

(21) Appl. No.: 14/109,089

(22) Filed: Dec. 17, 2013

(65) Prior Publication Data

US 2015/0166245 A1 Jun. 18, 2015
US 2016/0376085 A9 Dec. 29, 2016

Related U.S. Application Data

(60) Provisional application No. 61/738,523, filed on Dec. 18, 2012.

(51) Int. Cl.
*F21V 33/00* (2006.01)
*B65D 81/38* (2006.01)
*A47G 23/02* (2006.01)

(52) U.S. Cl.
CPC ..... *B65D 81/3876* (2013.01); *A47G 23/0241* (2013.01); *A47G 2023/0275* (2013.01)

(58) Field of Classification Search
CPC ..... A47G 19/2288; A47G 23/0233; A47G 23/0266; A47G 23/0309; A47G 2023/0275; A47G 23/0241; B65D 51/248; B65D 21/0228; B65D 81/3876
USPC ..... 362/101, 154, 253; 220/212, 739, 740
See application file for complete search history.

(56) References Cited

U.S. PATENT DOCUMENTS

| | | | | |
|---|---|---|---|---|
| 4,577,474 | A | 3/1986 | Peterson | |
| 4,823,974 | A | 4/1989 | Crosser | |
| 4,862,913 | A * | 9/1989 | Wildfang | F16K 15/063 137/516.29 |
| 5,186,350 | A | 2/1993 | McBride | |
| 5,271,244 | A * | 12/1993 | Staggs | 62/457.3 |
| 5,921,431 | A | 7/1999 | Pych | |
| 6,039,207 | A | 3/2000 | Adamek | |
| 6,086,216 | A * | 7/2000 | Goldfarb | 362/101 |
| 6,315,153 | B1 * | 11/2001 | Osborn | 220/737 |
| 6,330,808 | B1 * | 12/2001 | Kouwenberg | F25D 3/08 62/372 |

(Continued)

*Primary Examiner* — Peggy Neils
*Assistant Examiner* — Tsion Tumebo
(74) *Attorney, Agent, or Firm* — Conley Rose, P.C.; Grant Rodolph

(57) ABSTRACT

A closure for a beverage container holder, comprising a unitary closure assembly, comprising an integral hole having a diameter, wherein the diameter is sufficient to passably dispose a neck of a beverage container bottle therethrough, and wherein the diameter is smaller than the diameter of the beverage container bottle, a resiliently compressible lining disposed about the inner circumference of the integral hole, a gripping area for a user's hand, and a lateral engaging surface constructed of a resiliently compressible material and capable of exerting a lateral engaging force against a lateral engaging surface for a beverage container holder when integrally positioned, wherein the lateral engaging surface is generally cylindrical, and wherein the lateral engaging surface is of a narrower diameter than the gripping area and a larger diameter than the integral hole.

21 Claims, 4 Drawing Sheets

(56) References Cited

U.S. PATENT DOCUMENTS

| | | | | |
|---|---|---|---|---|
| 6,604,649 | B1 * | 8/2003 | Campi | 220/739 |
| 6,626,326 | B2 * | 9/2003 | Murakami | 220/739 |
| 6,705,110 | B1 * | 3/2004 | Worsham | 62/457.4 |
| 6,814,252 | B2 | 11/2004 | Murakami et al. | |
| 6,860,399 | B2 | 3/2005 | Reeves | |
| 7,032,409 | B1 | 4/2006 | Worsham | |
| 7,040,776 | B2 * | 5/2006 | Harrell et al. | 362/154 |
| 7,114,628 | B2 | 10/2006 | Guevara | |
| 7,232,237 | B2 * | 6/2007 | Bigger | 362/154 |
| 7,328,876 | B2 * | 2/2008 | Jones | 248/311.2 |
| 7,614,516 | B2 | 11/2009 | Beggins | |
| 7,857,360 | B2 * | 12/2010 | Lambert | F16L 37/098 137/528 |
| 7,882,975 | B2 | 2/2011 | Kelly | |
| 2002/0014491 | A1 * | 2/2002 | Duff et al. | 220/592.16 |
| 2006/0043250 | A1 * | 3/2006 | Farrell | 248/311.2 |
| 2009/0255941 | A1 | 10/2009 | Kuntz | |

* cited by examiner

BEVERAGE BOTTLE INSULATING APPARATUS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Various beverages are preferably served at a particular temperature. A wide variety of techniques have been employed to keep beverages as close to the optimum consuming temperature as possible for as long as possible. For example, ice buckets have been used to chill wine, and foam and/or fabric insulation devices, e.g., koozies, have been employed to insulate beverages in cans or bottles. Prior techniques suffer from a variety of drawbacks, e.g., spilling, slipping, poor thermal performance characteristics, difficulty of use, etc. Accordingly, one object of this disclosure is to provide a simple, effective technique for neatly maintaining temperature of a beverage in a container.

SUMMARY

In one embodiment, the disclosure includes a closure for a beverage container holder, comprising a unitary closure assembly, comprising an integral hole having a diameter, wherein the diameter is sufficient to passably dispose a neck of a beverage container bottle therethrough, and wherein the diameter is smaller than the diameter of the beverage container bottle, a resiliently compressible lining disposed about the inner circumference of the integral hole, a gripping area for a user's hand, and a lateral engaging surface constructed of a resiliently compressible material and capable of exerting a lateral engaging force against a lateral engaging surface for a beverage container holder when integrally positioned, wherein the lateral engaging surface is generally cylindrical, and wherein the lateral engaging surface is of a narrower diameter than the gripping area and a larger diameter than the integral hole.

In another embodiment, the disclosure includes a beverage container holder, comprising a removable closure, wherein the closure comprises an integral hole having a diameter sufficient to passably dispose a neck of a beverage container bottle therethrough, wherein the diameter is smaller than the body of the beverage container bottle, a resiliently compressible lining disposed about the inner circumference of the integral hole, a gripping area for a user's hand, and a lateral engaging surface, wherein an outer surface of the lateral engaging surface is generally cylindrical, and wherein the lateral engaging surface is of a narrower diameter than the gripping area and a larger diameter than the integral hole, and a rigid housing for receiving a bottle, wherein the housing comprises an opening for receiving the closure, wherein the lateral engaging surface and the rigid housing are configured to detachably couple using a mechanism selected from a group consisting of: friction, compression, and threading.

In yet another embodiment, the disclosure includes a method of maintaining temperature of a beverage in a bottle, comprising situating the bottled beverage in a housing, and sealably disposing a removable closure on the housing, wherein the closure comprises an integral hole having a diameter sufficient to passably dispose a neck of a beverage container bottle therethrough, wherein the diameter is smaller than a diameter of the beverage container bottle body, a lining disposed about the inner circumference of the integral hole, a gripping area for a user's hand, and an engaging surface, wherein the engaging surface is of a larger diameter than the integral hole, wherein the engaging surface comprises a sealing assembly, wherein the engaging surface sealably couples the closure to the housing, and wherein a neck of the bottle is passably disposed through the integral hole such that the lining makes contact with the neck of the bottle.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

The disclosure includes a beverage container holder for holding beverage containers, e.g., glass bottles, plastic bottles, etc., providing thermal insulating characteristics, and/or permitting a user to pour a beverage from the container without removing the beverage from the holder. The disclosure includes a cap, also referred to herein as a closure, and a housing. In some embodiments, the closure and housing are separable. In other embodiments, the closure and housing are connected, e.g., using hinges, straps, a tether, or other fasteners permitting the closure to be temporarily removed from the housing in order to place a bottle within the housing. The closure and housing are discussed further below. Embodiments of the beverage container holder may permit a beverage to be poured out of a bottle while contained within the beverage container holder, e.g., without the use of additional spouts, nozzles, straws, or other devices. Such embodiments may permit a user to make direct contact with the beverage container, e.g., permitting a user to drink directly from the bottle, while preserving thermal integrity of the beverage container holder. In some embodiments, a sealing mechanism may be employed to prevent leakage of any fluids which may be internal to the beverage container holder and external to the beverage container, e.g., condensation and/or melted ice.

Figure 1:
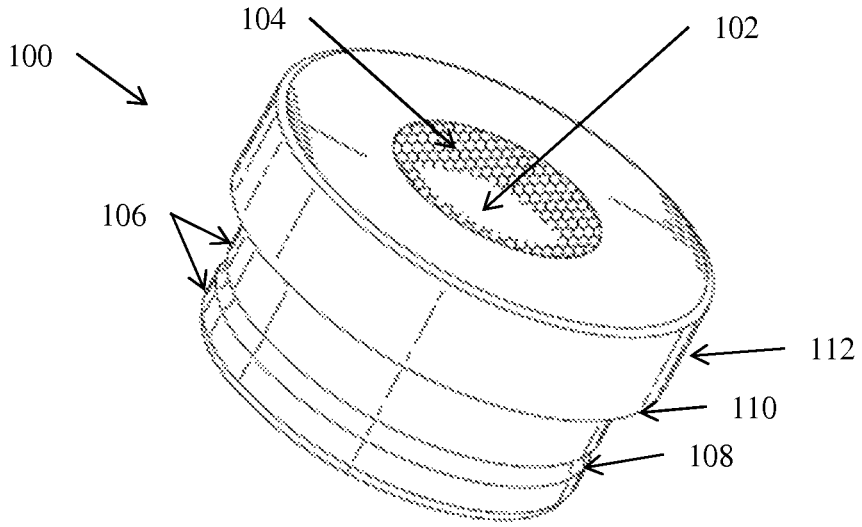
FIG. 1 is a perspective view of an embodiment of a closure.

FIG. 1 is a perspective view of an embodiment of a closure 100. The closure 100 may be a substantially rigid unitary assembly and may comprise an integral hole 102. As used herein, the term unitary may mean that the closure is an assemblage constructed to act as a single unit, e.g., having no moving or user-separable parts. An absence of moving parts may provide certain desirable characteristics, e.g., durability, ease of use, ease of construction, reliability, etc. The integral hole 102 may have a size sufficient to permit the neck of a bottle, e.g., a wine, beer, or other beverage bottle, to be passably disposed therethrough. As used herein, the term neck may refer to the portion of a bottle below the mouth or upper opening of the bottle and above the body of the bottle. The integral hole 102 may optionally accommodate bottle necks of lesser diameters. The size of the integral hole 102 may be selected based on the mean or median bottle neck diameter as utilized in the relevant industry.

The integral hole 102 may include a lining 104, e.g., a thermally insulating material. The lining 104 may be affixed to the interior diameter of the integral hole, e.g., using an epoxy or bonding agent. The lining 104 may contact some or all of a disposed bottle neck, and may provide certain benefits, e.g., improved thermal performance of the beverage container holder, increased vertical or horizontal stability of a bottle when disposed within a housing (not depicted), e.g., a thermal insulating housing for a bottled beverage, etc. The lining 104 may be constructed of a resilient, compressible, and/or flexible non-fibrous material, e.g., rubber, neoprene, urethane, and/or any combination thereof. Alternately, the lining 104 may be constructed with a fibrous material, e.g., felt, wool, textile matting, etc.

The closure 100 may be designed such that a lateral engaging surface 106 may be sealably, slidably, detachably, and/or otherwise engaged against a portion of a rim of a housing for a bottled beverage (not depicted). As depicted, the lateral engaging surface 106 comprises an upper and lower area and is generally cylindrical. As will be understood by those of skill in the art, other embodiments may comprise a unitary, tripartite, etc., lateral engaging surface 106 within the scope of this disclosure. In one embodiment, the closure 100 is slidably affixed to the housing (not depicted) using frictional force and/or compressive force between the housing and the lateral engaging surface 106 and/or an integral sealing assembly 108, e.g., a ring assembly, an annular groove, etc. Some embodiments may include other affixing structures, e.g., compressible O-ring(s), threads, latches, ribs, studs, baffles, etc., to help increase frictional force on the lateral engaging surface 106 or a horizontal engaging surface 110. Some embodiments of the closure 100 may be designed to engage with a plurality of different housings. For example, the same closure 100 may be interchangeably utilized on a housing for a 1.5 liter bottle beverage container and a housing for a 750 milliliter (mL) bottle beverage container.

The closure 100 may also comprise a gripping area 112. As shown, the gripping area 112 is smooth. In some embodiments, the gripping area 112 may comprise regular or irregular surface features, such as corrugations, castellations, scallops, concave trenches, convex protrusions, rings, any other features, or any combination thereof. The surface features may help increase frictional force experienced between the closure 100 and a user's hand. Alternately, the surface features may improve the aesthetics of the beverage container holder. Additionally, various ornamental additions may be utilized in conjunction with the closure 100 and/or housing surface, e.g., user-selectable battery powered light emitting diodes (LEDs), one or more switches for turning on the LEDs, a battery compartment, etc., for example, for use in identifying one closure 100 and/or housing from another.

Figure 2:
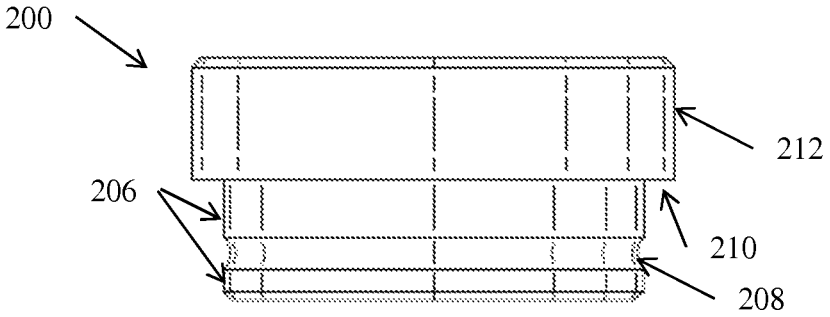
FIG. 2 is an elevation view of an embodiment of a closure.

FIG. 2 is an elevation view of an embodiment of a closure 200. The elements of the closure 200 may be substantially the same as the elements of the closure 100 of FIG. 1 except as otherwise noted. The closure 200 may comprise a lateral engaging surface 206, a sealing assembly 208, a horizontal engaging surface 210, and a gripping area 212.

Figure 3:
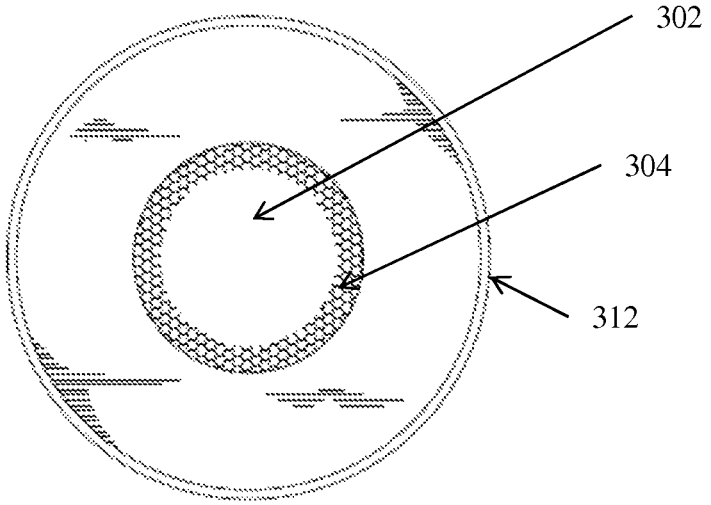
FIG. 3 is a top plan view of an embodiment of a closure.

FIG. 3 is a top plan view of an embodiment of a closure 300. The elements of the closure 300 may be substantially the same as the elements of the closure 100 of FIG. 1 except as otherwise noted. The closure 300 may comprise an integral hole 302, a lining 304, and a gripping area 312.

Figure 4:
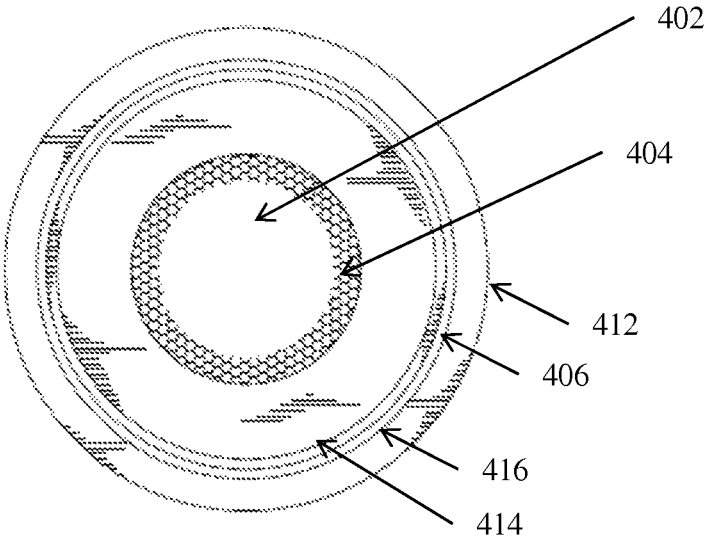
FIG. 4 is a bottom plan view of an embodiment of a closure.

FIG. 4 is a bottom plan view of an embodiment of a closure 400. The elements of the closure 400 may be substantially the same as the elements of the closure 100 of FIG. 1 except as otherwise noted. The closure 400 may comprise an integral hole 402, a lining 404, a lateral engaging surface 406, and a gripping area 412. As depicted, the inner surface 414 of the lateral engaging surface 406 is substantially parallel with respect to the outer surface 416 of the lateral engaging surface 406. In some embodiments, the inner aspect or inner surface 414 of the lateral engaging surface 406 may take a divergent angle with respect to the outer surface 416, e.g., creating a contour matching a beverage container, a generally frusto-conical shape that narrows to the diameter of the integral hole 402 as it reaches the integral hole 402, etc.

Figure 5:
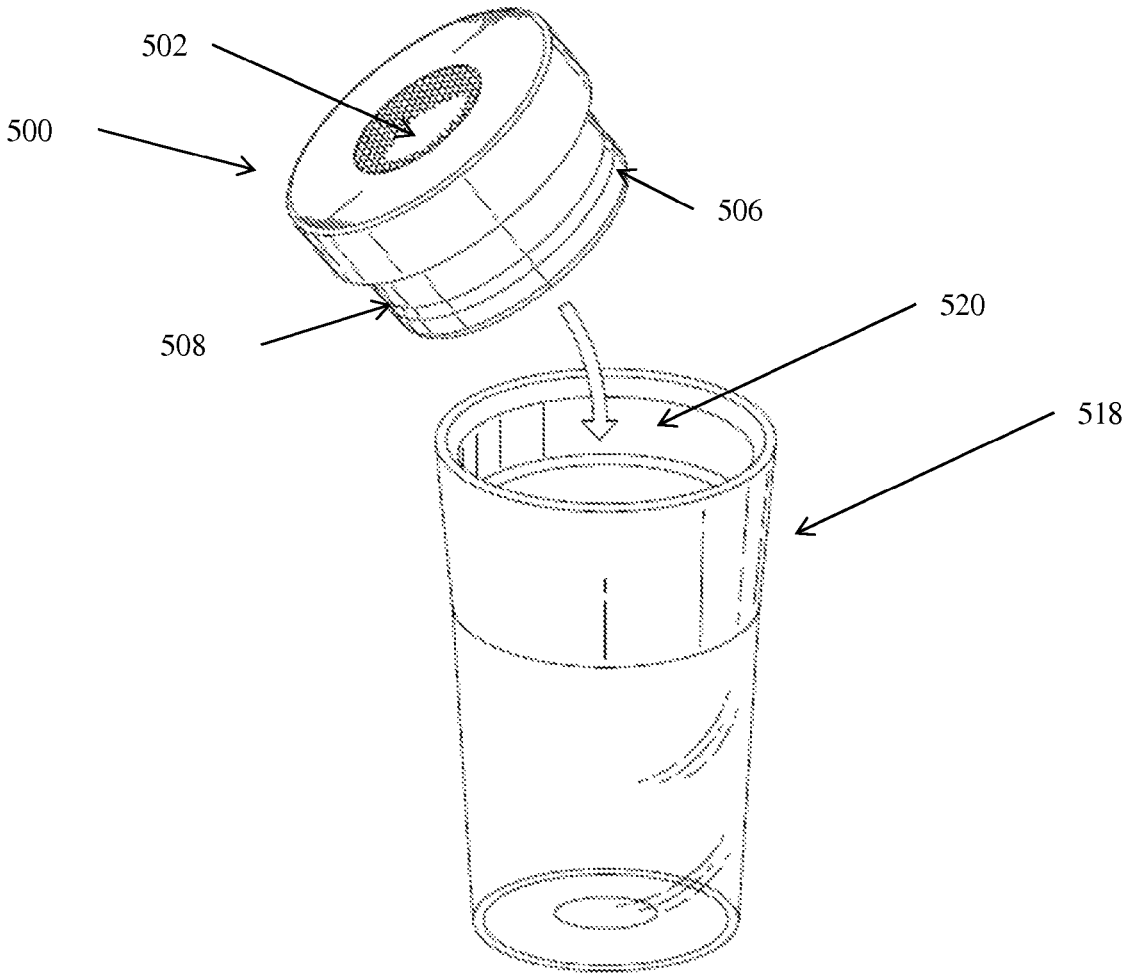
FIG. 5 is a perspective view of an embodiment of a closure and a housing.

FIG. 5 is a perspective view of an embodiment of a closure 500 in conjunction with a generally cylindrical housing 518. The elements of the closure 500 may be substantially the same as the elements of the closure 100 of FIG. 1 except as otherwise noted. The closure 500 may comprise an integral hole 502 and a lateral engaging surface 506. As indicated, the closure 500 may be slidably placed into the upper opening of the housing 518. A compressive force may be experienced by the lateral engaging surface 506 (or an expansive force may be exerted by the lateral engaging surface 506) when disposed within the housing lateral engaging surface 520, which force may be sufficient to prevent slippage and/or easily dislodging the closure 500 once in the set position. A sealing assembly 508 may comprise an O-ring, disk, one or more raised (e.g., finger, bump, etc.) elements, or other element(s) to increase resistance and/or provide a sealing surface to assist in temperature regulation and/or prevent leakage. The housing 518 may be a housing, e.g., a thermally insulated housing, for holding a beverage container, e.g., a bottle. The housing 518 may be configured to hold any suitable size, shape, and/or material of beverage containers. The interior of the housing 518 may engage a portion, e.g., the bottom, or all of the beverage container. In an embodiment, the housing 518 may take the form of a generally cylindrical or frusto-conical shaped body comprising a top, a bottom, and one or more sides. Some embodiments may reflect an inner surface contoured to match the shape of the intended beverage container. Some embodiments of the housing 518 are shaped and/or contoured primarily for aesthetic purposes, and others may include a handle or gripping surface to facilitate use within the scope of this disclosure. The bottom interior of the housing 518 may be configured to have a size generally equal to the size of the bottom of the beverage container, and the top opening of the housing 518 may be configured to have a size generally equal to the maximum diameter of the beverage container. The bottom of the housing 518 may be weighted. The housing 518 may have other desirable features, e.g., stability in securing the beverage container, flexibility in adjusting vertical positions of the beverage container, capability to accommodate various sizes of beverage containers, vacuum insulated walls, sufficient space to accommodate a quantity of ice, and so forth. Alternate embodiments include a housing 518 capable of holding heat sources, e.g., heating coils or hot stones, or heat sinks, e.g., ice cubes, in addition to the beverage container. The outer surface of the housing 518 may be designed to fit into a cup holder, such as those found in automobiles, boats, and golf carts. Alternately, the outer surface of the housing 518 may be designed to fit into a conventional restaurant wine bucket stand.

The closure 500 and/or housing 518 may accommodate various sizes of beverage containers. Wine bottles may be about 750 mL, but may come in different sizes, e.g., 187 mL, 375 mL, 500 mL, 1 liter and 1.5 liter, and may contain different beverages. For example, certain U.S. standard bottles may be about 16-ounce (oz.), 12-oz. or 7-oz. in capacity. The 12-oz. bottle, for example, may have a diameter of about 2.4 inches. Optionally, the design may accommodate non-standard bottle sizes, e.g., 40-oz., 64-oz., 31.8-oz., etc. Further, a beverage container may be made of any material including, but not limited to, metal (tin, aluminum, etc.), glass, plastic, any other suitable material, and/or any combination thereof.

The disclosed closure 500 and/or the housing 518 may comprise any suitable material. Suitable structural materials may include, but are not limited to, plastic materials such as polycarbonate (PC), polyvinyl chloride (PVC), polystyrene (PS), polyethylene terephthalate (PET), acrylonitrile butadiene styrene (ABS), elastomers such as poly dimethylsiloxane (PDMS), metallic materials, glass or glass-like materials, any other suitable materials, and any combination thereof. Further, the disclosed holder may be manufactured or fabricated via any suitable technique and/or process. Possible fabrication techniques/processes may include, but are not limited to, casting, molding, e.g., injection molding, printing, direct structuring, any other suitable technique, or any combination thereof.

Depending on the structural material(s), a portion or all of the closure 500 and/or the housing 518 may be in any color. For example, if the closure 500 and/or the housing 518 is made of a glass or another transparent material, it may appear partially or fully clear. The transparency may be an attractive feature, as a consumer may see the beverages and the beverage label, if any, through the housing 518. The closure 500 and/or the housing 518 may also be any other color or any combination of colors. To further increase marketability of the disclosed beverage container holder, decorative elements may be added. For example, advertisements of vendors such as sports teams, restaurants, beverage suppliers, etc., may be printed, engraved, or affixed onto the closure 500 and/or housing 518. In addition, other information such as personalized greetings, messages, Bible verses, pictures, occasion-specific information (e.g., birthdays, Halloween, Christmas), etc., may also be added to the closure 500 and/or the housing 518.

Figure 6:
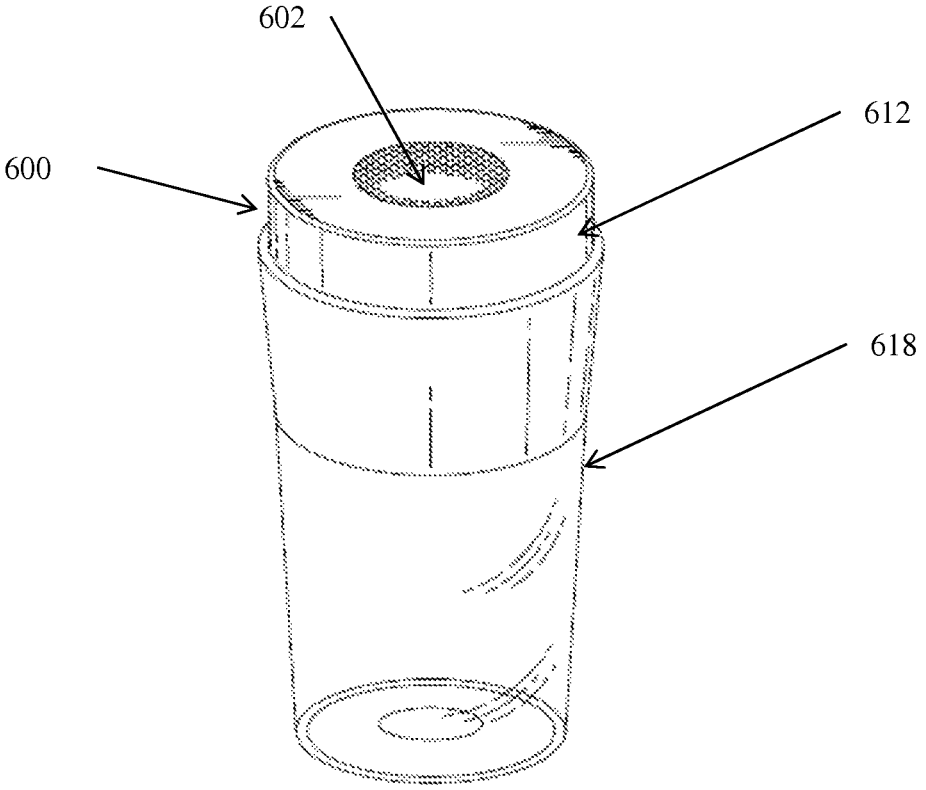
FIG. 6 is another perspective view of an embodiment of a closure and a housing.

FIG. 6 is another perspective view of an embodiment of a closure 600 coupled to a housing 618. The elements of the closure 600 may be substantially the same as the elements of the closure 100 of FIG. 1 except as otherwise noted. The closure 600 may comprise an integral hole 602 and a gripping area 612.

Figure 7:
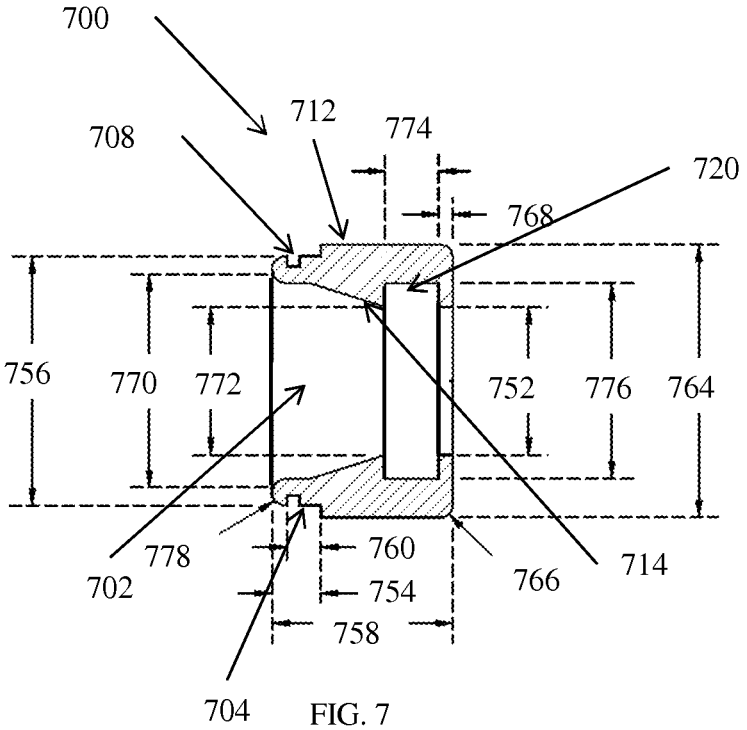
FIG. 7 is a schematic cross section of another embodiment of a closure.

FIG. 7 is a schematic cross section of another embodiment of a closure 700. The elements of the closure 700 may be substantially the same as the elements of the closure 100 of FIG. 1 except as otherwise noted. The closure 700 may comprise an integral hole 702, a lateral engaging surface 704, a sealing assembly 708, a gripping area 712, an inner surface 714, a liner channel 720 for a lining (not depicted). The diameter 752 of the integral hole 702 may be about 1.5 inches (in.). The width 754 of the lateral engaging surface 704 may be about 0.5 in and the diameter 756 of the lateral engaging surface 704 may be about 2.5 in. The width 760 of the sealing assembly 708 and the upper portion of the lateral engaging surface 704 may be about ⅜ in. The overall width 758 of the closure 700 may be about 1 and 13/16 in. The diameter 764 of the gripping area 712 may be about 2 and 13/16 in., and the top corner 766 of the gripping area 712 may be beveled using about a ⅛ radian curve over about a ⅛ in. section 768 of the gripping area. The inner surface 714 may be angled to create a frusto-conical shape from a first lower diameter 770 of about 2 and 3/16 in. to a second upper diameter 772 of about 1.5 in. The liner channel 720 may have a width 774 of about 9/16 in. and a diameter 776 of about 2 in. The bottom edge 778 of the closure 700 may be cut at an angle of about 30 degrees over about a 1/16 in. width area, e.g., to facilitate slidably coupling the closure 700 to a housing. The sealing assembly 708 may have a depth of about 0.129 in. and a width of about 0.14 in. As will be understood by those of skill in the art and as discussed above, this embodiment is merely illustrative and one or more of the above dimensions may be altered, e.g., adjusting size measurements according to the provided ratio, to accommodate a broader bottle neck or alternate construction materials, to incorporate different sealing elements, etc., within the scope of this disclosure.

As will be apparent to those of skill in the art, some embodiments of the closure do not include fasteners, hinges, levers, threads, switches, batteries, LEDs, moveable components, e.g., spill covers, zippers, latches, springs, etc., or other components in addition to the unitary housing elements described above. Some embodiments of the closure may be substantially cylindrical in outward appearance and may have a flat upper surface, lacking a dome shape. Embodiments lacking one or more of these elements may streamline production and/or increase lifespan of the closure. Further, while the application discusses disposing a closure within an opening of a housing, it will be apparent that other embodiments may reverse the lateral engaging surface of the closure and housing such that the closure fits over the top/outside of the housing rather than within/inside the housing. Such embodiments are within the scope of the present disclosure.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 7 percent, . . . , 70 percent, 71 percent, 72 percent, . . . , 97 percent, 96 percent, 97 percent, 98 percent, 99 percent, or 100 percent. Moreover, any numerical range defined by two R numbers as defined in the above is also specifically disclosed. The use of the term "about" means±10% of the subsequent number, unless otherwise stated. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

What is claimed is:

1. A closure for a beverage container holder, comprising:

an integral hole having an inner diameter, wherein the inner diameter is sufficient to passably dispose a neck of a beverage container bottle therethrough, and wherein the inner diameter is smaller than an outer diameter of the beverage container bottle;

a gripping area;

a lateral engaging surface configured to secure the closure to a housing configured to accept the beverage container bottle, and wherein the lateral engaging surface is of a narrower diameter than the gripping area and a larger diameter than the integral hole;

a liner channel situated in the integral hole, wherein a resiliently compressible lining is at least partially positioned in the liner channel and does not extend above or below the liner channel; and a horizontal surface positioned between the gripping area and the lateral engaging surface, wherein an upper surface of the housing is below the horizontal surface when the closure is engaged with the housing, wherein the horizontal surface is substantially perpendicular to the gripping area, wherein the horizontal surface is substantially perpendicular to the lateral engaging surface, and wherein an outer diameter of the gripping area is substantially the same as an outer diameter of the housing.

2. The closure of claim 1, wherein a longitudinal length of the lateral engaging surface is shorter than a longitudinal length of the gripping area, wherein the lateral engaging surface comprises an upper engaging surface, a lower engaging surface, and a channel positioned between the upper engaging surface and the lower engaging surface, wherein the channel has a different diameter than either the upper engaging surface or the lower engaging surface, wherein at least some of the lateral engaging surface is constructed of a resiliently compressible material configured to exert a force on an inside wall of the housing when the closure engages the housing, wherein the lateral engaging surface comprises a sealing assembly, and wherein the sealing assembly comprises an O-ring or a disk.

3. The closure of claim 1, wherein the resiliently compressible lining is disposed about an inner circumference of the integral hole, wherein the closure has a cylindrical axis, wherein the lateral engaging surface faces away from the cylindrical axis, wherein the lateral engaging surface comprises threads that are configured to engage with opposing threads on the inside of the housing, and wherein the gripping area is substantially flush with the outside of the housing when the closure engages the housing.

4. The closure of claim 1, wherein an interior aspect of the lateral engaging surface comprises a generally frusto-conical shape that narrows from a bottom of the lateral engaging surface to the inner diameter of the integral hole as the interior aspect reaches the integral hole.

5. The closure of claim 1, wherein the gripping area comprises one or more features to increase a frictional force between the gripping area and a user's hand, and wherein the features are selected from a group consisting of: corrugations, castellations, scallops, concave trenches, convex protrusions, and rings.

6. The closure of claim 1, wherein the lining is selected from a group consisting of: rubber, neoprene, urethane, felt, wool, and textile matting.

7. The closure of claim 3, wherein the closure further comprises an angled surface on a bottom end of the lateral engaging surface for facilitating slidably coupling the closure to the housing, and wherein the liner channel is positioned above the lateral engaging surface.

8. A beverage container holder, comprising:

a removable closure, wherein the closure comprises:

an integral hole having an inner diameter sufficient to passably dispose a neck of a beverage container bottle therethrough, wherein the inner diameter is smaller than a body of the beverage container bottle;

a resiliently compressible lining disposed about an inner circumference of the integral hole, wherein the resiliently compressible lining is at least partially positioned in a liner channel and does not extend above or below the liner channel;

a gripping area for a user's hand; and a lateral engaging surface, wherein the lateral engaging surface is of a narrower diameter than the gripping area and a larger diameter than the integral hole;

a horizontal surface positioned between the gripping area and the lateral engaging surface, wherein the horizontal surface is substantially perpendicular to the gripping area, and wherein the horizontal surface is substantially perpendicular to the lateral engaging surface; and a housing for receiving the beverage container bottle, wherein the housing comprises an area for receiving the closure, wherein the housing does not extend upwardly past the horizontal surface, wherein an outer diameter of the gripping area is substantially the same as an outer diameter of the housing, wherein the gripping area is substantially flush with the outside of the housing when the closure engages the housing, and wherein the lateral engaging surface and the housing are configured to detachably couple using a mechanism selected from a group consisting of: friction, compression, and threading.

9. The beverage container holder of claim 8, wherein an inner surface of the lateral engaging surface comprises a generally frusto-conical shape that narrows from a bottom of the lateral engaging surface to the inner diameter of the integral hole as the inner surface reaches the integral hole.

10. The beverage container holder of claim 8, wherein the lateral engaging surface comprises an angled surface on a bottom end of the lateral engaging surface for facilitating coupling of the closure to the housing.

11. The beverage container holder of claim 8, wherein the liner channel is positioned above the lateral engaging surface, wherein the lateral engaging surface comprises threads that are configured to engage with opposing threads on the inside of the housing, wherein the closure has no moving parts, wherein the closure is substantially cylindrical in outward appearance when detachably coupled to the housing, wherein the closure has a cylindrical axis, wherein the lateral engaging surface faces away from the cylindrical axis, and wherein the closure is configured to permit the neck of the beverage container bottle to be sufficiently disposed therethrough such that a user may make direct contact with the beverage container bottle.

12. The beverage container holder of claim 8, wherein the housing and an inner surface of the lateral engaging surface are contoured to generally conform to a shape of the beverage container bottle.

13. The beverage container holder of claim 8, wherein a longitudinal length of the lateral engaging surface is shorter than a longitudinal length of the gripping area, wherein the lateral engaging surface comprises an upper engaging surface, a lower engaging surface, and a channel positioned between the upper engaging surface and the lower engaging surface, wherein the channel has a different diameter than either the upper engaging surface or the lower engaging surface, wherein at least some of the lateral engaging surface is constructed of a resiliently compressible material configured to exert a force on an inside wall of the housing when the closure engages the housing, wherein the lateral engaging surface comprises a sealing assembly, and wherein the sealing assembly comprises an O-ring or a disk.

14. A method, comprising:

instructing a user to situate a bottled beverage in a housing; and instructing the user to engage a removable closure onto the housing, wherein the closure comprises:

an integral hole having an inner diameter sufficient to passably dispose a neck of a beverage container bottle therethrough, wherein the inner diameter is smaller than an outer diameter of the beverage container bottle;

a lining disposed about an inner circumference of the integral hole, wherein the lining is affixed to a liner channel situated around the integral hole, and wherein the lining does not extend above or below the liner channel;

a gripping area for a user's hand, wherein an outer diameter of the gripping area is substantially the same as an outer diameter of the housing, and wherein the gripping area is substantially flush with an outside of the housing when the closure engages the housing;

an engaging surface, wherein the engaging surface is of a larger diameter than the integral hole, wherein the closure has a cylindrical axis, wherein the engaging surface and the gripping area both face away from the cylindrical axis, wherein the engaging surface comprises a sealing assembly, and wherein the engaging surface sealably couples the closure to the housing; and a horizontal surface positioned between the gripping area and the engaging surface, wherein the housing does not extend upwardly past the horizontal surface, wherein the horizontal surface is substantially perpendicular to the gripping area, and wherein the horizontal surface is substantially perpendicular to the engaging surface.

15. The method of claim 14, wherein the neck of the beverage container bottle is passably disposed through the integral hole such that the lining makes contact with the neck of the beverage container bottle, and wherein the engaging surface comprises threads that are configured to engage with opposing threads on the inside of the housing.

16. The method of claim 15, wherein the liner channel is positioned above the engaging surface, wherein the lining is at least partially positioned in the liner channel, and wherein the lining is selected from a group consisting of: rubber, neoprene, urethane, felt, wool, and textile matting.

17. The method of claim 14, wherein an interior surface of the closure is generally frusto-conical in shape and narrows from a bottom of the engaging surface to the diameter of the integral hole as the interior surface reaches the integral hole, and wherein a top of the frusto-conical shape is the integral hole.

18. The method of claim 14, wherein the engaging surface is a generally cylindrical engaging surface, wherein the engaging surface comprises an angled surface on a bottom end for facilitating detachable coupling of the closure to the housing, wherein the closure is slidably coupled to the housing, and wherein frictional force or an expansive force exerted by the engaging surface on the housing reinforces the coupling of the engaging surface to the housing.

19. The method of claim 17, wherein the sealing assembly comprises an O-ring, wherein the engaging surface comprises an angled surface on a bottom end of the engaging surface for facilitating detachable coupling of the closure to the housing, wherein the closure is slidably coupled to the housing, and wherein the closure has no moving parts.

20. A beverage container holder, consisting of:

a closure comprising:

an integral hole having an inner diameter, wherein the inner diameter is sufficient to passably dispose a neck of a beverage container bottle therethrough, and wherein the inner diameter is smaller than an outer diameter of the beverage container bottle;

a liner channel situated around the integral hole;

a resiliently compressible lining that does not extend above or below the liner channel, wherein the resiliently compressible lining is at least partially positioned in the liner channel;

a gripping area for a user's hand;

a lateral engaging surface, wherein the lateral engaging surface is generally cylindrical, and wherein the lateral engaging surface is of a narrower diameter than the gripping area and a larger diameter than the integral hole; and a horizontal surface positioned between the gripping area and the lateral engaging surface, wherein the horizontal surface is substantially perpendicular to the gripping area, and wherein the horizontal surface is substantially perpendicular to the lateral engaging surface; and a housing for receiving the beverage container bottle, wherein the housing comprises an opening for receiving the closure, wherein an upper surface of the housing is below the horizontal surface when the closure is engaged with the housing, wherein an outer diameter of the gripping area is substantially the same as an outer diameter of the housing, and wherein the lateral engaging surface and the housing are configured to detachably couple using a mechanism selected from a group consisting of: friction, compression, and threading.

21. The beverage container holder of claim 20, wherein the liner channel is positioned above the lateral engaging surface, wherein the resiliently compressible lining is disposed about an inner circumference of the integral hole, wherein the closure has a cylindrical axis, wherein the lateral engaging surface faces away from the cylindrical axis, wherein the lateral engaging surface comprises threads that are configured to engage with opposing threads on the inside of the housing, wherein the gripping area is substantially flush with the outside of the housing when the closure engages the housing, and wherein an inner surface of the lateral engaging surface comprises a generally frusto-conical shape that narrows from a bottom of the lateral engaging surface to the inner diameter of the integral hole as the inner surface reaches the integral hole.

* * * * *